US009752347B2

(12) United States Patent
Seitz et al.

(10) Patent No.: US 9,752,347 B2
(45) Date of Patent: Sep. 5, 2017

(54) HANDLE

(71) Applicants: DMG MORI AKTIENGESELLSCHAFT, Bielefeld (DE); DMG MORI CO., LTD., Yamatokoriyama-shi, Nara (JP)

(72) Inventors: Reinhold Seitz, Hopferau (DE); Alexander Strebelow, Wasserburg (DE)

(73) Assignees: DMG MORI AKTIENGESELLSCHAFT, Bielefeld (DE); DMG MORI CO., LTD., Yamatokoriyama (JP)

( * ) Notice: Subject to any disclaimer, the term of this patent is extended or adjusted under 35 U.S.C. 154(b) by 0 days.

(21) Appl. No.: 15/021,835

(22) PCT Filed: Sep. 11, 2014

(86) PCT No.: PCT/EP2014/069406
§ 371 (c)(1),
(2) Date: Mar. 14, 2016

(87) PCT Pub. No.: WO2015/036491
PCT Pub. Date: Mar. 19, 2015

(65) Prior Publication Data

US 2016/0230416 A1 Aug. 11, 2016

(30) Foreign Application Priority Data

Sep. 13, 2013 (EP) ..... 13184342

(51) Int. Cl.
*E05B 1/00* (2006.01)

(52) U.S. Cl.
CPC ..... *E05B 1/0015* (2013.01); *Y10T 16/498* (2015.01)

(58) Field of Classification Search
CPC .. E05B 1/0015; Y10T 16/498; Y10T 16/4576; Y10T 16/4644; Y10T 16/513;
(Continued)

(56) References Cited

U.S. PATENT DOCUMENTS 1,684,277 A * 9/1928 Holland ..... H01M 2/1005 16/444
2,234,097 A * 3/1941 Tinnerman ..... E05B 1/0015 16/110.1
(Continued)

FOREIGN PATENT DOCUMENTS

DE 10 2011 087757 A1 6/2013
FR 1 322 990 A 4/1963
(Continued)

OTHER PUBLICATIONS

Dec. 5, 2014 International Search Report issued in International Patent Application No. PCT/EP2014/069406.

*Primary Examiner* — William Miller
(74) *Attorney, Agent, or Firm* — Oliff PLC

(57) ABSTRACT

A handle can be fastened to a main body by way of screws and includes a main profiled part having two receiving portions and at least two slot nuts, which each have a threaded hole for receiving one of the screws. One slot nut each is inserted in a receiving portion and can be clamped in the receiving portion when a screw, which passes through the main body, is screwed into the threaded hole. The clamping of the slot nuts generates tensile stresses which pull the main profiled part in the direction of the surface of the main body and thus secure the main profiled part to the main body.

14 Claims, 7 Drawing Sheets

(58) Field of Classification Search
CPC ..... Y10T 16/44; A47B 2095/023; A47B 2095/024; A47B 95/02; B25G 1/10; A45C 13/26
USPC .... 16/436, 410, 419, 444, 110.1; 312/348.6; 81/489
See application file for complete search history.

(56) References Cited

U.S. PATENT DOCUMENTS

| | | | | | |
|---|---|---|---|---|---|
| 2,329,767 | A * | 9/1943 | Jakeway | A47B 95/02 | 16/415 |
| 3,995,349 | A * | 12/1976 | Roberts | A47B 95/02 | 16/412 |
| 5,740,587 | A * | 4/1998 | Onai | A47B 95/02 | 16/412 |
| 7,357,467 | B2 * | 4/2008 | Lee | A47B 95/02 | 16/422 |

FOREIGN PATENT DOCUMENTS

| | | | |
|---|---|---|---|
| FR | 1 387 217 | A | 1/1965 |
| WO | 2011/026274 | A1 | 3/2011 |

* cited by examiner

Fig. 4D
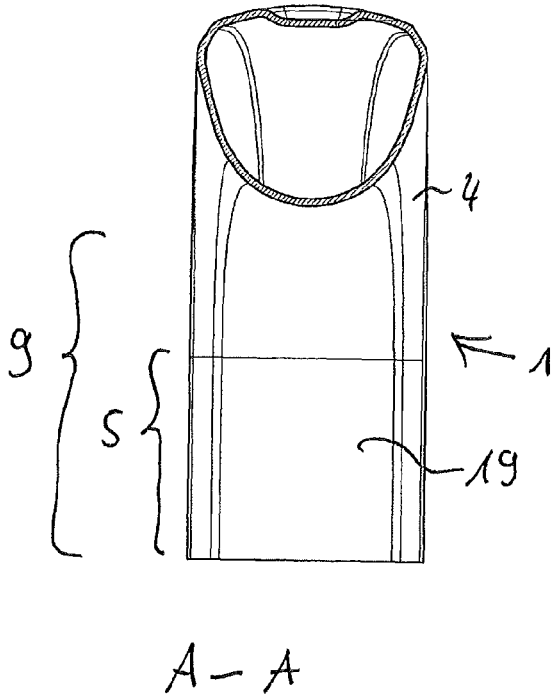
Fig. 4C
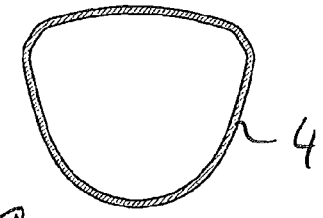
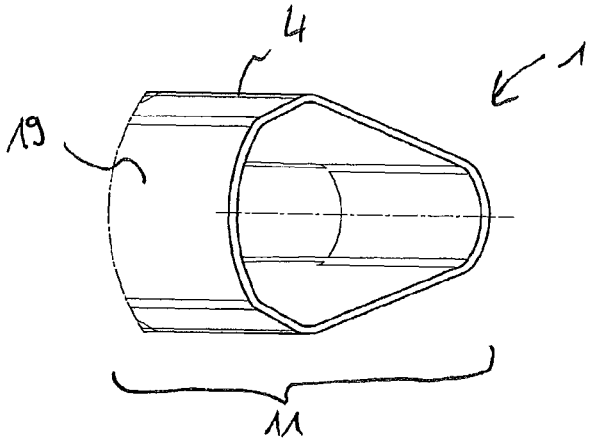
Fig. 4E

Fig. 5B
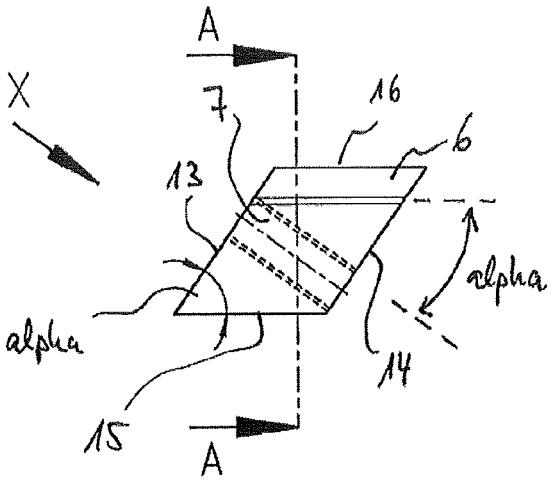
Fig. 5C
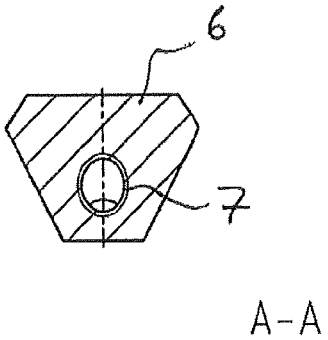
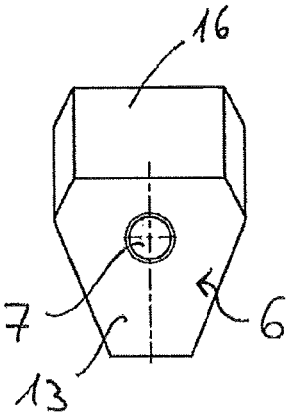
Fig. 5A

HANDLE

FIELD OF THE INVENTION

The invention relates to handle which can be fastened to a main body.

BACKGROUND OF THE INVENTION

Handles are used for a plurality of different purposes. For example, a door/flap of a machine tool can be provided with a handle, by means of which a person can open the door/flap. In this connection, a handle is desirable which has a simple design and can simultaneously be mounted with little effort and, after fastening it to a main body, is secured in rigid and stable fashion.

SUMMARY OF THE INVENTION

A handle according to one exemplary aspect can be fastened to a main body by means of screws and comprises a main profiled part having at least two receiving portions and at least two slot nuts, which each have a threaded hole for receiving one of the screws. One slot nut each (which can also be referred to as a groove stone) can be inserted in a receiving portion and can be clamped in the receiving portion when a screw, which passes through the main body, is screwed into the threaded hole. The clamping of the slot nuts can generate tensile stresses which pull the main profiled part in the direction of the surface of the main body and thus secure the main profiled part to the main body.

In particular, a handle is exemplarily proposed which has a main profiled part with two receiving portions at the end, wherein the receiving portions preferably extend so as to be inclined towards one another, and at least two slot nuts which each have respective threaded holes for receiving the screws, wherein each of the slot nuts is designed or formed so as to be inserted in a respective receiving portion and wherein an at least part of the outer profile cross-section of the slot nuts is adapted to the respective inner profile cross-sections of the receiving portions.

Exemplarily, the handle is rigidly securable to the main body by inserting each of the slot nuts in a respective receiving portion and by fastening it in the respective threaded hole when a respective screw, which passes through the main body, is screwed in, such that the main profiled part is clamped between the rigidly secured slot nuts, wherein, where applicable, tensile stresses are exerted in the direction of the surface of the main body on the main profiled part at least while the screws are screwed in.

Due to the use of slot nuts having threaded holes, the design of the handle can be simple and the assembly of the handle to the main body can be simple.

When the handle is mounted, the slot nuts are advantageously aligned opposite to the receiving portions in such a way that the tensile stresses have components which act in directions that are opposite to one another and run in parallel to a surface of the main body. In this way, it is possible to improve the inherent rigidity of the handle and the stability of the attachment to the main body.

The main profiled part can have a first end portion and a second end portion, wherein at least one slot nut is mounted to be slidable in the first end portion and wherein at least one slot nut is mounted to be slidable in the second end portion. Therefore, the slot nuts can be inserted in, or removed from, the main profiled part in a simple way.

The main profiled part can have a first bend and a second bend. The first end portion can here be located in an area of the first bend and the second end portion can be located in an area of the second bend. As a result, the handle can be produced in a particularly simple way since the entire main profiled part can hence be made in one piece.

At least one slot nut can have a trapezoidal cross-section, and a corresponding receiving portion, which receives the slot nut so as to be slidable, can also have a trapezoidal cross-section which corresponds to the trapezoidal cross-section of the slot nut. Particularly good clamping of the slot nut in the main profiled part is ensured by the trapezoidal cross-section.

This is in particular the case when the threaded hole extends through the at least one slot nut from a first side of the trapezoid to a second side of the trapezoid, said second side being opposite to the first side (preferably perpendicularly to the first side), such that the direction of the threaded hole and a third side and a fourth side of the trapezoid, said fourth side being opposite to the third side, in each case enclose an angle of more than 0 and/or less than 90°. The threaded hole can here run fully through the slot nut from the first side to the second side or up to a threaded end in the slot nut interior.

The handle can advantageously be designed as follows: In the region of a first end, the main profiled part can have a first hollow body-like portion (part of the first bend) and in the region of the second end a second hollow body-like portion (part of the second bend), wherein a first side region (surface region) of the first hollow body-like portion, said first side region facing a surface of the main body, and the surface form an angle of more than 90° and a second side region (surface region) of the second hollow body-like portion, said second side region facing the surface, and the surface form an angle of less than 90°.

The first slot nut can be mounted to be slidable in the first hollow body-like portion, and the second slot nut can be mounted to be slidable in the second hollow body-like portion. A first screw can be connected to the first slot nut by means of a threaded hole in the first slot nut, into which the first screw can be screwed, in order to fasten the first slot nut on the surface, and a second screw can be connected to the second slot nut by means of a threaded hole in the second slot nut, into which the second screw can be screwed, in order to fasten the second slot nut on the surface.

When the first screw is connected to the first slot nut, a force is exerted on the first slot nut and presses the first slot nut in the direction of the surface against the first side region, and when the second screw is connected to the second slot nut, a force is exerted on the second slot nut and presses the second slot nut in the direction of the surface against the second side region.

A side ("bottom side") of the first slot nut/second slot nut, said side facing the surface of the main body, can be aligned parallel to the surface when the first slot nut/second slot nut is connected to the first screw/second screw.

The bottom side of the first slot nut/second slot nut can be flush with the first end/second end of the main profiled part when the first slot nut/second slot nut is connected to the first screw/second screw. It is thus possible to increase the surface area by means of which the main profiled part rests on the surface of the main body, as a result of which dents on the surface of the main body can be avoided.

The threaded hole in the first slot nut/second slot nut can be aligned perpendicularly to the bottom side of the first slot nut/second slot nut. Furthermore, the threaded hole can be aligned perpendicularly to the surface of the main body when the first slot nut/second slot nut is connected to the first screw/second screw.

A bush can be provided for each screw and penetrates, and is attached to, the main body, wherein each screw can be inserted in the appropriate bush and wherein the screw can be inserted by means of an end facing the main profiled part in the threaded hole of the appropriate slot nut and has a stop at an end facing away from the main profiled part, said stop striking a bush end facing away from the main profiled part when the screw is inserted in the bush. In this embodiment, the bottom side of the first slot nut/second slot nut can rest on a bush end facing the main profiled part when the first slot nut/second slot nut is connected to the first screw/second screw. Since the main profiled part/the first slot nut/second slot nut do thus not necessarily have to rest on the main body, dents on the surface of the main body can be avoided, where applicable.

The first hollow body-like portion/second hollow body-like portion and the first slot nut/second slot nut can be designed in such a way that the first slot nut/second slot nut can slide in the first hollow body-like portion/second hollow body-like portion in a direction which is inclined with respect to the surface but when connected to the first fastening element/second fastening element is pulled in a direction which intersects the first side region (surface region)/second side region (surface region). As a result, the first slot nut/second slot nut is pressed against the first side region/second side region, which is necessary to generate the tensile stresses.

The cross-sectional profile of the basic profile can be designed in the central region in a way that differs from that of the bends, e.g. such that the slot nuts cannot slip through the central region of the main profiled part. Therefore, the assembly of the handle can be simplified.

According to a useful embodiment, the main profiled part has a first end portion which includes one of the receiving portions and a second end portion which includes the other receiving portion, wherein the end portions extend so as to be inclined towards one another, and wherein, prior to the fastening by means of the screws, one of the slot nuts is mounted to be slidable in the first end portion of the main profiled part after the insertion and wherein, prior to the fastening by means of the screws, the other one of the slot nuts is mounted to be slidable in the second end portion of the main profiled part after the insertion.

Here, it is also preferred that at least three sides of a longitudinal cross-section (in particular in a plane perpendicular to the profile cross-section and/or perpendicular to the surface of the main body) of one of the receiving portions has a first trapezoid shape, wherein a first side of the first trapezoid shape corresponds to an opening of the main profiled part at the end and the at least three sides of the first trapezoid shape also have a third side and a fourth side of the first trapezoid, said fourth side being opposite to the third side, and the third and fourth sides of the first trapezoid shape correspond to wall portions of the receiving portion.

At least three sides of a longitudinal cross-section (in particular in a plane perpendicular to the profile cross-section and/or perpendicular to the surface of the main body) of one of the slot nuts preferably have a second trapezoid shape, wherein a first side of the second trapezoid shape has a threaded hole and the threaded hole runs from the first side of the second trapezoid to a second side of the slot nut, said second side being opposite to the first side, and the at least three sides of the second trapezoid shape furthermore comprise a third side and a fourth side of the second trapezoid, said fourth side being opposite thereto.

The slot nut can preferably be inserted in the corresponding receiving portion through the opening of the main profiled part at the end and is mounted to be slidable in the corresponding receiving portion after the insertion in the direction of the parallel extending second and third sides of the first and/or second trapezoid shape.

The direction of the threaded hole is preferably aligned substantially at a perpendicular angle to the first side of the first and/or second trapezoid and the direction of the threaded hole and preferably the third side and the fourth side of the first and/or second trapezoid, said fourth side being opposite thereto, in each case enclose an angle (alpha) of more than 0 and/or less than 90 degrees.

When fastened, the slot nuts are preferably secured by means of the screws screwed into the threaded holes via the first side of the trapezoid shape of the slot nuts so as to face the main body, such that longitudinal directions of the trapezoid shape of the slot nuts are inclined towards one another and the main profiled part is clamped between the slot nuts by means of the third and fourth sides of the trapezoid shape of the two slot nuts.

According to a further, particularly useful embodiment, a first one of the slot nuts can be inserted in a first one of the receiving portions at the end, such that the first slot nut is slidable in the first receiving portion in a first direction of the receiving portion (and more preferably only slidable in the first direction, i.e. cannot be rotated and/or is blocked in positive fashion in other directions transversely to the first direction). Furthermore, a second one of the slot nuts can also preferably be inserted in a second one of the receiving portions at the end, such that the second slot nut is slidable in the second receiving portion in a second direction of the receiving portion (and more preferably is only slidable in the second direction, i.e. cannot be rotated and/or is blocked in positive fashion in other directions transversely to the second direction).

The first direction and the second direction are preferably inclined towards one another. This blocks the handle or the main profiled part in the fastened state, which is rigid and clamped between the slot nuts by positive engagement, as soon as both slot nuts which are received in the receiving portions are secured to the main body by means of the screws.

The first direction and the second direction preferably enclose an angle (on the side of the main body) of substantially between 30 and 120 degrees, more preferably an angle between 50 and 100 degrees.

Exemplary aspects of the invention are explained in more detail below in an exemplary embodiment with reference to the drawings.

BRIEF DESCRIPTION OF THE DRAWINGS

FIG. 4C shows a cross-sectional diagram of the handle according to FIG. 4A along a sectional plane A-A illustrated in FIG. 4A, FIG. 4D shows a cross-sectional diagram of the handle according to FIG. 4A along the sectional plane A-A in the viewing direction X, FIG. 4E shows a top view of an end of the handle according to FIG. 4A, FIG. 5A shows a perspective diagram of an embodiment of the slot nut illustrated in FIG. 1, FIG. 5B shows a side view (corresponds to the longitudinal cross-sectional shape) of the slot nut illustrated in FIG. 5A, FIG. 5C shows a cross-sectional diagram of the slot nut illustrated in FIG. 5A along the sectional plane A-A illustrated in FIG. 5B.

DETAILED DESCRIPTION OF THE EXEMPLARY EMBODIMENTS

In the figures, identical or matching areas, components or component assemblies are designated by the same reference signs.

Figure 1:
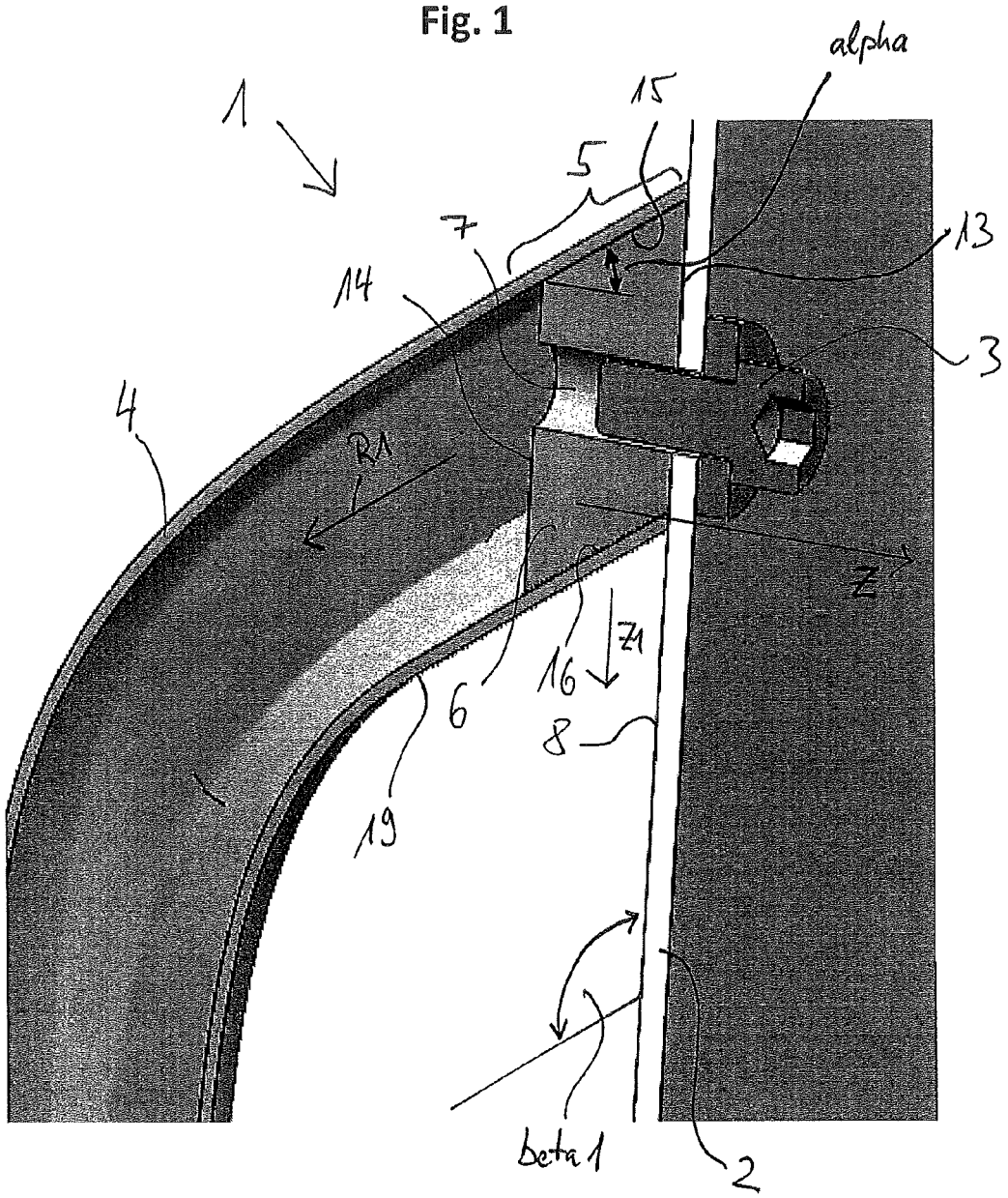
FIG. 1 shows a perspective cross-sectional diagram of part of a handle according to an exemplary embodiment of the invention.
Figure 4A:
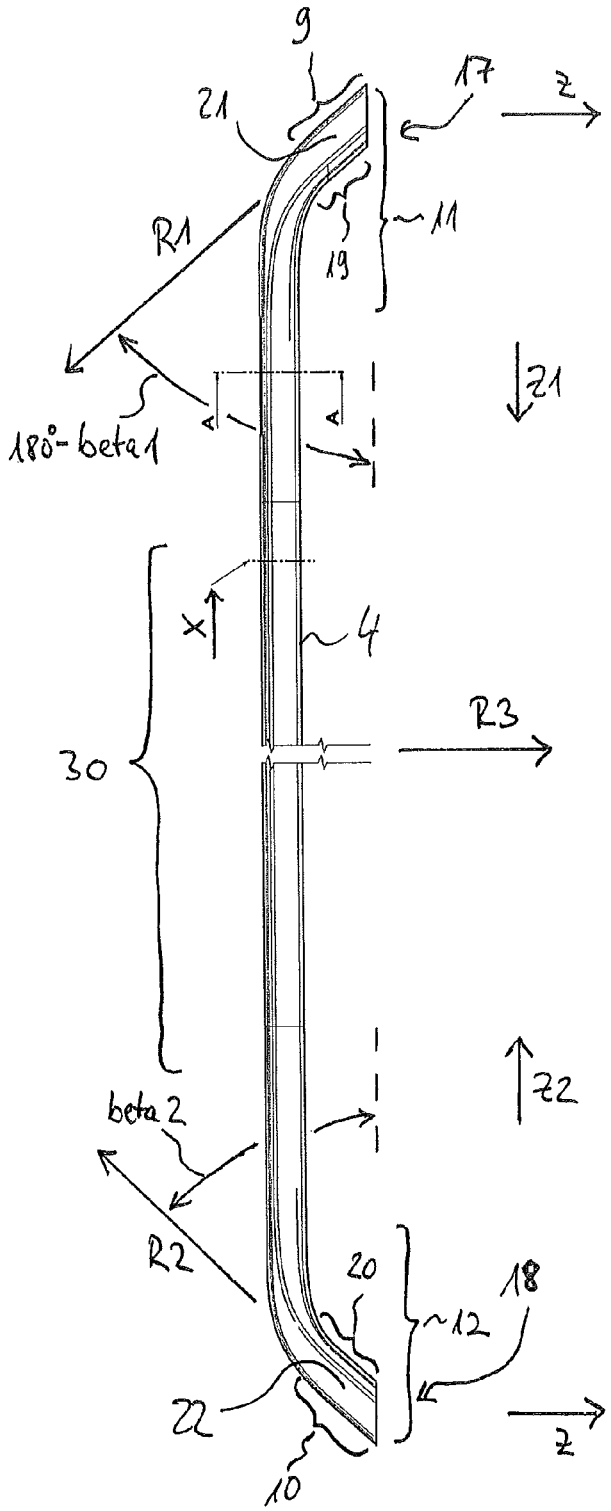
FIG. 4A shows a side view of the handle illustrated in FIG. 1 and FIG. 2.
Figure 4B:
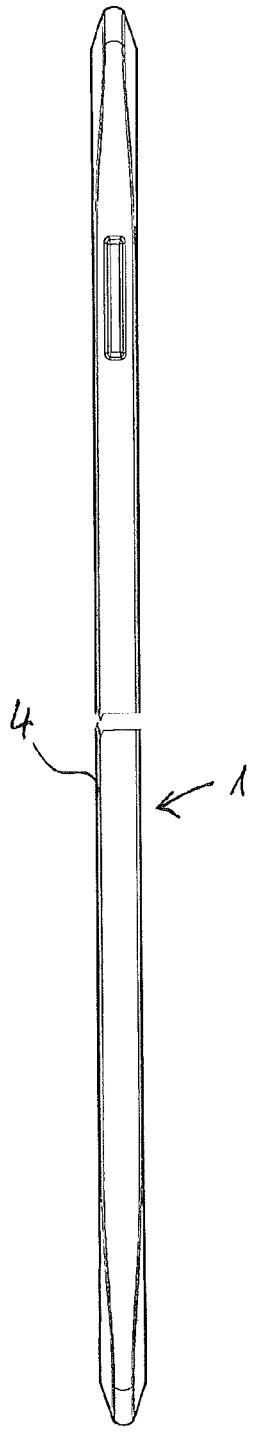
FIG. 4B shows a top view of the handle according to FIG. 4A.

FIGS. 1 and 4A show a handle 1 according to an exemplary embodiment of the invention. The handle 1 can be fastened to a main body 2 by means of screws 3 and comprises a main profiled part 4 having two receiving portions 5 and two slot nuts 6, which each have a threaded hole 7 for receiving one of the screws 3.

One slot nut 6 each is inserted in a receiving portion 5 and can be clamped in the receiving portion 5 when a screw 3, which passes through the main body 2, is screwed into the threaded hole 7. The clamping of the slot nuts 6 generates tensile stresses Z which pull the main profiled part 4 in the direction of the surface 8 of the main body 2 and thus secure the main profiled part to the main body 2.

FIG. 1 shows by way of example only one end of the main profiled part 4. The other end of the main profiled part 4, as shown in FIG. 4A, is designed in analogy to FIG. 1 (in particular both ends are symmetrical by way of example and in particular formed symmetrically in relation to a plane extending perpendicularly to the central portion 30).

A simple design of the handle 1 and a simple assembly of the handle 1 on the main body 2 are possible by the use of slot nuts 6 having threaded holes 7.

When the handle 1 is mounted, the slot nuts 6 are advantageously aligned with respect to the receiving portions 5 in such a way that the tensile stresses include components Z1, Z2, which act in directions which are opposite to one another and extend parallel to the surface 8 of the main body 2. In this way, the inherent rigidity of the handle 1 and the stability of the attachment to the main body 2 can be improved and the handle can be rigidly clamped between the slot nuts 6.

As shown in FIG. 4A, the main profiled part 4 has a first end portion 9 and a second end portion 10, wherein at least one slot nut 6 is mounted to be slidable in the first end portion 9 (in a direction R1), and wherein at least one slot nut 6 is mounted to be slidable in the second end portion 10 (in a direction R2). Therefore, the slot nuts 6 can easily be inserted in, or removed from, the main profiled part 4.

The main profiled part 4 has a first bend 11 and a second bend 12. The first end portion 9 is here located in a region of the first bend 11 and the second end portion 10 in a region of the second bend 12. As a result, the handle 1 can be produced in a particularly simple way since the entire main profiled part 4 can thus be produced in one piece.

Figure 3A:
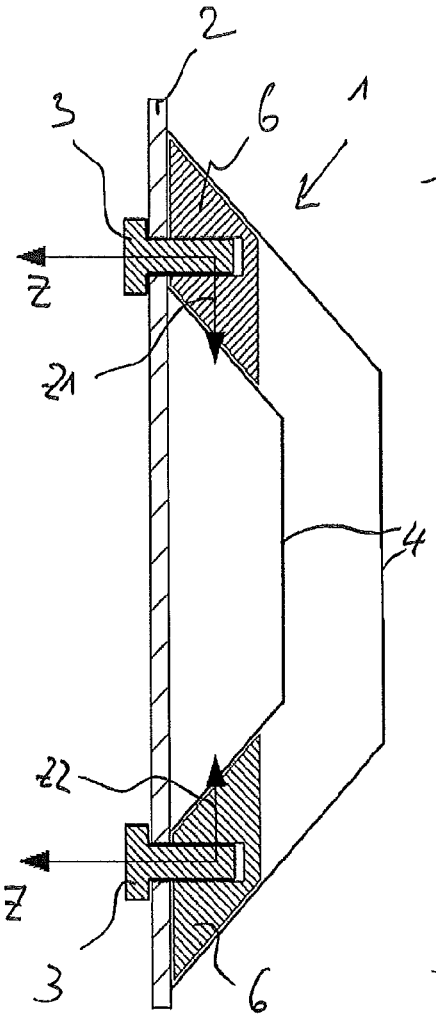
FIG. 3A shows a schematic cross-sectional diagram through a securing mechanism according to an exemplary embodiment of the invention in a secured state.
Figure 3B:
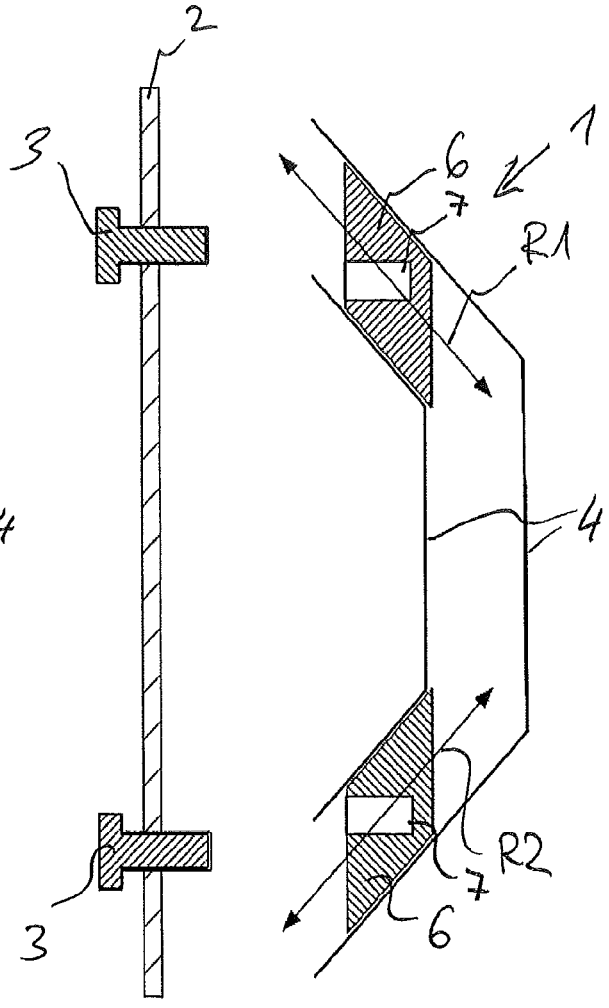
FIG. 3B shows a schematic cross-sectional diagram through a securing mechanism according to the exemplary embodiment of the invention according to FIG. 3A in an non-secured state.

In a side view of the handle 1, i.e. in the viewing direction of FIGS. 4A, 3A and 3B, the slot nuts 6 have a trapezoidal cross-section (longitudinal cross-section, not to be confused with the profile cross-section), as also shown in FIG. 5B (the side view in FIG. 5B corresponds to the longitudinal cross-section). Here, it is particularly designed that at least three sides follow a trapezoidal shape, wherein a side of the slot nuts, which is exposed in the interior of the main profiled part, is not limited in form and can be designed substantially as desired.

A corresponding receiving portion 5, which receives the slot nut 6 so as to be slidable, has in a side view, i.e. in the viewing direction of FIGS. 4A, 3A and 3B, also a trapezoidal cross-section (longitudinal cross-section, not to be confused with a profile cross-section) which corresponds to the trapezoidal cross-section of the slot nut 6, as shown in FIG. 1, for example. However, here only two sides of the trapezoid are confined by profile walls, wherein a third side corresponds to an end opening of the handle 1 or the main profiled part 4 and a trapezoid side which is exposed in the interior of the main profiled part represents an imaginary side.

A particularly good clamping effect of the slot nut 6 is ensured in the main profiled part 4 by the cross-section which has a trapezoidal shape at least on three sides. This is the case in particular when the threaded hole 7 extends through the slot nut 6 from a first side 13 of the trapezoid to a second side 14 of the trapezoid, said second side being opposite to the first side, such that the direction of the threaded hole 7 and a third side 15 and a fourth side 16 of the trapezoid, said fourth side being opposite thereto, in each case enclose an angle alpha>0 (and preferably also less than 90°) (i.e. does not run parallel to the third side 15 and the fourth side 16).

FIG. 3A shows a schematic cross-sectional diagram (longitudinal section, not to be confused with profile cross-section) through a securing mechanism according to an exemplary embodiment of the invention in a secured state, and FIG. 3B shows a schematic cross-sectional diagram through a fastening mechanism according to the exemplary embodiment of the invention according to FIG. 3A in a non-secured state. These diagrams show the principle of the securing mechanism.

As shown in FIG. 3B, the slot nuts 6 according to the above exemplary embodiments preferably have a trapezoidal shape in a longitudinal section, wherein the threaded holes 7 are formed perpendicularly to the outer side of the trapezoidal shape of the slot nuts 6. The outer sides of the slot nuts 6 can be inserted in the end portions of the main profiled part 4 so as to be aligned parallel to the surface of the main body 2 and, when inserted, can be freely displaced or slide in the respective longitudinal direction of the profile R1 or R2 (i.e. always perpendicularly to the profile cross-section) of the end portions in the inner profile of the end portions of the main profiled part 4. "Inclined towards one another" here means in particular that they do not extend in parallel.

In the fastened state according to FIG. 3A, the slot nuts 6 are rigidly secured to the main body by means of screws 3 and extend in the interior of the end portions of the main profiled part 4. Here, the outer side of the slot nuts 6 rests by way of example on the surface of the main body 2 (however, can also rest on washers or the like), and inner sides of the slot nut are in contact with the inner walls of the main profiled part 4. The main body 4 of the handle 1 as such is not directly fastened to the main body 2 but is rigidly clamped between the slot nuts 6.

Since the upper slot nut 6 in FIG. 3A is mounted to be only slidable in the direction R1, such that the main body 4 might be removed in direction R1 unless the lower slot nut 6 was fastened, and the lower slot nut in FIG. 3A is mounted to be only slidable in direction R2, such that the main body 4 might be removed in direction R2 unless the upper slot nut 6 was fastened, and the two directions R1 and R2 do not run in parallel and in particular run transversely to one another, the respective movability of the main body 4 in directions R1 and R2 is blocked in each case in positive engagement by the lower and upper slot nuts 6, respectively, and the handle 1 is rigidly secured by clamping the main body between the slot nuts 6.

In the exemplary embodiment according to FIG. 4A, the handle 1, which is designed in axis-symmetric fashion by way of example, can preferably be made as follows: The main profiled part 4 has in the region of a first end 17 a first hollow body-like portion 21 (part of the first bend 11) and in the region of the second end 18 a second hollow body-like portion 22 (part of the second bend 12), wherein a first side region (surface region) 19 of the first hollow body-like portion 21, said side region facing a surface 8 of the main body 2, and the surface 8 form an angle beta1 of more than 90°, and a second side region (surface region) 20 of the second hollow body-like portion 22, said side region facing the surface 8, and the surface 8 form an angle beta2 of less than 90°.

The first slot nut 6 is mounted to be slidable in the first hollow body-like portion 21, and the second slot nut 6 is mounted to be slidable in the second hollow body-like portion 22. A first screw 3 can be connected to the first slot nut 6 by means of a threaded hole 7 in the first slot nut 6 into which the first screw 3 can be screwed, in order to fasten the first slot nut 6 on the surface 8, and a second screw 3 can be connected to the second slot nut 6 by means of a threaded hole 7 in the second slot nut 6, into which the second screw 3 can be screwed, in order to fasten the second slot nut 6 on the surface 8. When the first screw 3 is connected to the first slot nut 6, a force Z is exerted on the first slot nut 6 and presses the first slot nut 6 against the first side region 19 in the direction to the surface 8, and when the second screw 3 is connected to the second slot nut 6, a force Z is exerted on the second slot nut 6 and presses the second slot nut 6 against the second side region 20 in the direction of the surface 8.

In FIG. 1, a "bottom side" 13 of the first slot nut/second slot nut 6 is aligned in parallel to the surface 8 when the first slot nut/second slot nut 6 is connected to the first screw/second screw 3. In addition, the bottom side 13 of the first slot nut/second slot nut 6 is flush with the first end 17/second end 18 of the main profiled part 4 when the first slot nut/second slot nut 6 is connected to the first screw/second screw 3. It is therefore possible to increase a surface area by means of which the handle 1 rests on the surface 8 of the main body 2 (not only the end of the main profiled part 4 rests on the surface 8 but also the first slot nut/second slot nut 6), as a result of which dents on the surface 8 of the main body 2 can be avoided.

As is disclosed in FIG. 1, the threaded hole 7 is aligned in the first slot nut/second slot nut 6 perpendicularly to the bottom side 13 of the first slot nut/second slot nut 6, which faces the surface 8 of the main body. Furthermore, the threaded hole 7 is aligned perpendicularly to the surface 8 of the main body 2 when the first slot nut/second slot nut 6 is connected to the first screw/second screw 3.

Figure 2:
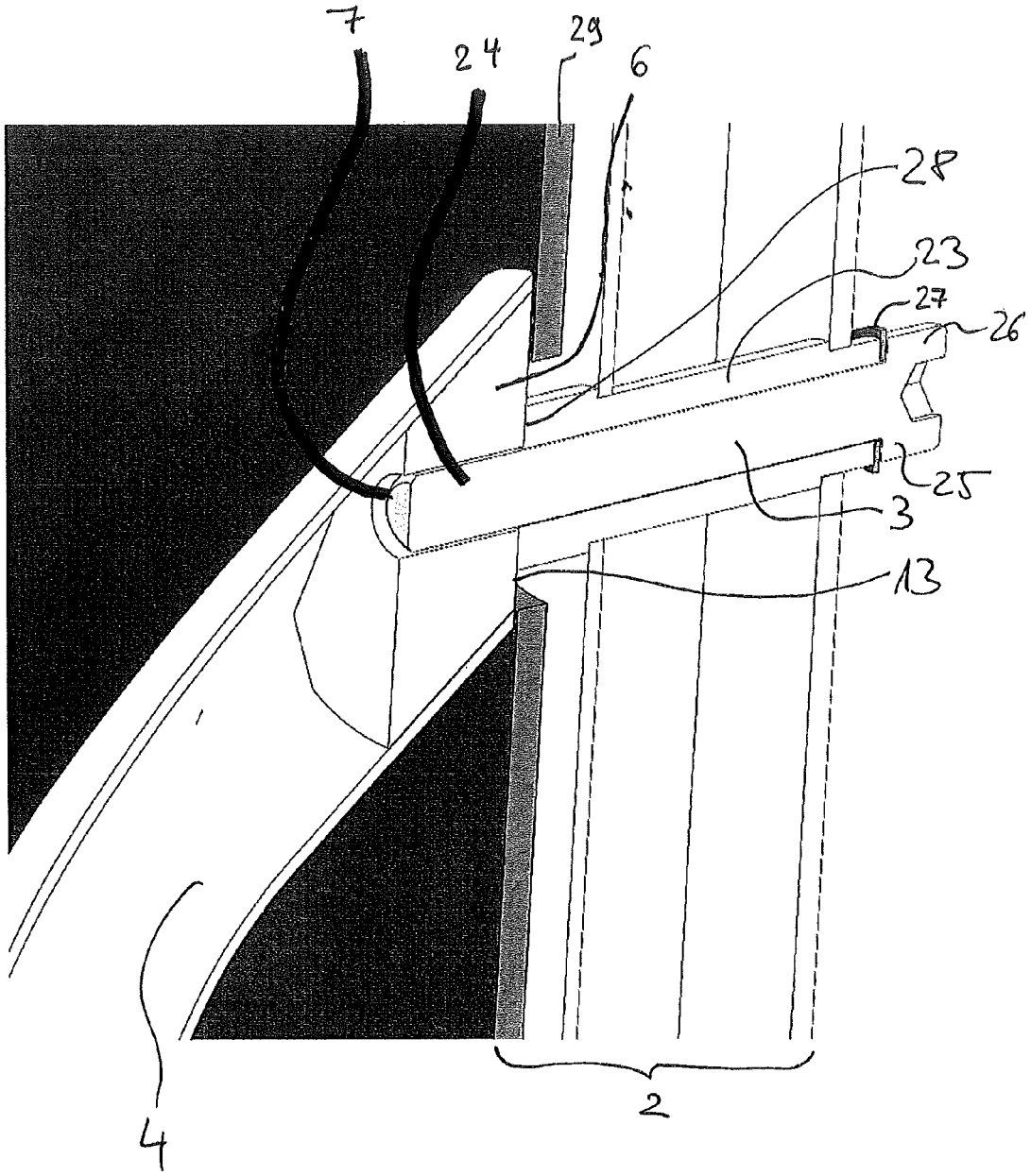
FIG. 2 shows a perspective cross-sectional diagram of part of a handle according to an exemplary embodiment of the invention.

As shown in FIG. 2, a bush 23 can be provided in further exemplary embodiments of the invention for each screw 3, said bush penetrating the main body 2 and being fastened thereto, wherein each screw 3 can be inserted in the corresponding bush 23 and wherein the screw 3 can be inserted with an end 24 facing the main profiled part 4 in the threaded hole 7 of the corresponding slot nut 6 and has a stop 26 on an end 25 facing away from the main profiled part 4, which stop when the screw 3 is inserted in the bush 23 strikes an end 27 of the bush 23, said end facing away from the main profiled part 4.

In this exemplary embodiment, the bottom side 13 of the first slot nut/second slot nut 6 can rest on an end 28 of the bush 23, which faces the handle body, when the first slot nut/second slot nut 6 is connected to the first screw/second screw 3. Therefore, the main profiled part 4 does not have to rest directly on the surface 8 of the main body 2, as a result of which the surface 8 can be made from a sensitive material without being damaged when the handle 1 is fastened. For example, as shown in FIG. 2, the surface 8 of the main body 2 can consist of a sensitive glass layer 29 or of another optically attractive material.

The first hollow body-like portion 21/second hollow body-like portion 22 and the first slot nut/second slot nut 6 can be designed in such a way that the first slot nut/second slot nut 6 can slide in the first hollow body-like portion 21/second hollow body-like portion 22 in a direction R1/T2, which is inclined with respect to the surface 8, but when it is connected to the first screw/second screw 3, it is pulled in a direction R3 which intersects the first side region 19/second side region 20.

The cross-section of the main profiled part 4 in a central region 30 can be different from the region of the bends 11, 12, such that the slot nuts 6 cannot slip through the central region 30 of the main profiled part 4. Therefore, the assembly of the handle 1 can be simplified since the first slot nut/second slot nut 6 cannot travel from the hollow body-like portions 22/23 to the central region 30.

FIG. 5A shows a perspective diagram of an exemplary embodiment of the slot nut 6 shown in FIG. 1 from a viewing direction X according to FIG. 5B. The side 13 of the slot nut represents the outer side of the slot nut 6, which in FIGS. 1, 2 and 3A rests on the surface of the main body 2, and an inlet opening of the threaded hole 7 is illustrated in FIG. 5A. When inserted, the represented side 16 of the slot nut 6 is at least in part in contact with the inner wall of the end portion/receiving portion 5 of the main profiled part 4 (see e.g. FIG. 1).

FIG. 5B shows a side view (corresponds to the longitudinal cross-sectional shape) of the slot nut shown in FIG. 5A, and here the longitudinal cross-sectional shape of slot nut 6 is shown, which has a trapezoidal shape, for example.

FIG. 5C is a profile cross-sectional diagram of the slot nut shown in FIG. 5A along the sectional plane A-A shown in FIG. 5B. When inserted, the slot nut 6 is slidable perpendicularly to the viewing direction of FIG. 5C (i.e. perpendicularly to the sectional plane axis A-A in FIG. 5B) in the end portion or receiving portion of the main profiled part 4 at the end in the direction R1 or R2. The profile of the slot nut 6 is here at least in part adapted to the cross-sectional profile of the main body 4 (see e.g. FIG. 4C).

Although the profile of the slot nut 6 according to FIG. 5C does not correspond to the cross-sectional profile of the main body 4 from FIG. 4C, it is adapted thereto so as to block a rotation of the slot nut 6 about the longitudinal direction of the profile. This further improves the rigidity and strength of the rigid attachment of the handle 1 according to this exemplary embodiment in an advantageous way and increases the stability of the attachment. An assembly of the handle is also facilitated since the slot nut 6 can only be inserted in the end portion of the main profiled part 4 in such a way that both the outer side 13 of the slot nut 6 and the threaded hole 7 are aligned properly in relation to the surface of the main body already when the slot nut is inserted and that, even in the inserted state before the attachment is made by means of the screws 3, they cannot be distorted by rotation of the slot nut 6 in the interior of the main profiled part 4 so as to lose the proper alignment.

Figure 6:
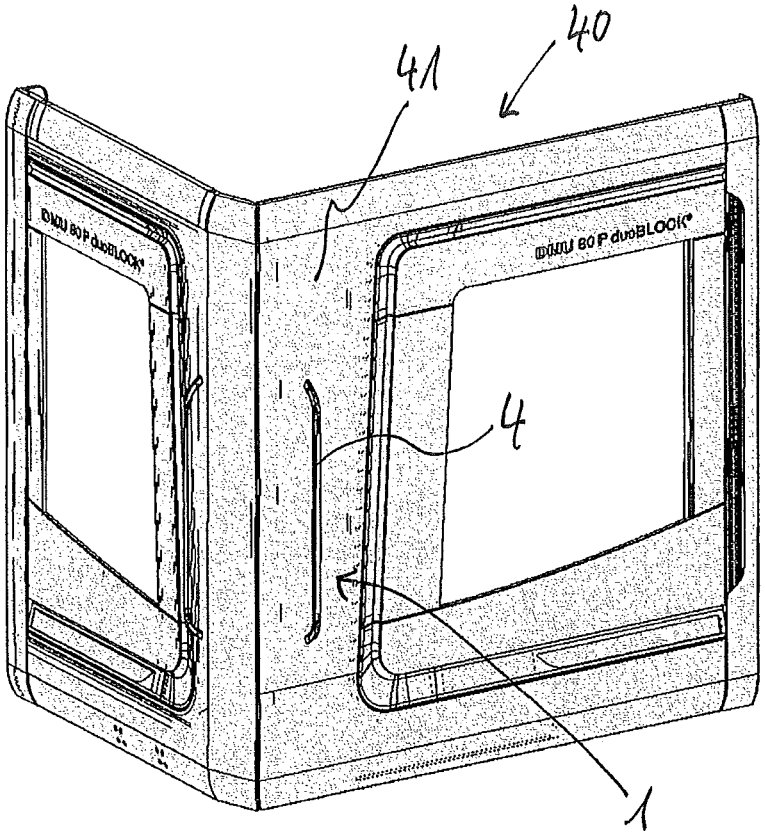
FIG. 6 shows a perspective diagram of the handle illustrated in FIG. 4A, mounted on a door of a machine tool.

Finally, FIG. 6 shows a perspective diagram of the handle 1 shown in FIG. 4A, mounted on a door 41 of a machine tool 40.

In summary, it is possible to provide by means of the invention a handle which can easily be produced, which has a simple design with only some few individual parts and can simultaneously be mounted with little effort and, after the attachment, is secured rigidly and in stable fashion to a main body.

The invention claimed is:

1. A handle for attachment to a main body by means of screws, comprising:

a main profiled part having two end portions, each end portion having a respective receiving portion at the respective end portion of the main profiled part, wherein the receiving portions extend so as to be inclined to one another; and two slot nuts, which have respective threaded holes for receiving the screws, wherein each of the slot nuts is made to be slidably inserted in the respective receiving portion, and wherein at least part of the outer profile cross-section of the slot nuts corresponds in shape to and mates with respective inner profile cross-sections of the receiving portions;

wherein the handle can be rigidly fixed to the main body when each of the slot nuts is slidably inserted in the respective receiving portion and is rigidly fixed to the main body by the respective screw, which passes through the main body, being screwed into the respective threaded hole of the respective slot nut, such that tensile stresses are generated in the direction of a surface of the main body and the main profiled part is clamped between the rigidly fixed slot nuts, wherein the receiving portions extend so as to be inclined opposite and away from one another and each receiving portion extending so as to be inclined with respect to an insertion direction of the respective screw, and the tensile stresses have components which act in directions which are opposite to one another and extend in parallel to the surface of the main body.

2. The handle according to claim 1, wherein the two end portions of the main profiled part include a first end portion and a second end portion, wherein the first and second end portions extend so as to be inclined towards one another, wherein one of the slot nuts is mounted to be slidable in the first end portion of the main profiled portion and wherein the other one of the slot nuts is mounted to be slidable in the second end portion of the main profiled part.

3. The handle according to claim 2, wherein the main profiled part has a first bend and a second bend and the first end portion is located in a region of the first bend and the second end portion is located in a region of the second bend.

4. A handle for attachment to a main body by means of screws, comprising:

a main profiled part having two end portions, each end portion having a respective receiving portion at the respective end portion of the main profiled part, wherein the receiving portions extend so as to be inclined to one another; and two slot nuts, which have respective threaded holes for receiving the screws, wherein each of the slot nuts is made to be slidably inserted in the respective receiving portion, and wherein at least part of the outer profile cross-section of the slot nuts corresponds in shape to and mates with respective inner profile cross-sections of the receiving portions;

wherein the handle can be rigidly fixed to the main body when each of the slot nuts is slidably inserted in the respective receiving portion and is rigidly fixed to the main body by the respective screw, which passes through the main body, being screwed into the respective threaded hole of the respective slot nut, such that tensile stresses are generated in the direction of a surface of the main body and the main profiled part is clamped between the rigidly fixed slot nuts, wherein at least one of the slot nuts has a trapezoidal longitudinal section, and a corresponding receiving portion which receives the slot nut in slidable fashion, also has a trapezoidal longitudinal section which corresponds to the trapezoidal longitudinal section of the slot nut.

5. The handle according to claim 4, wherein the threaded hole extends through the at least one slot nut from a first side of the trapezoid to a second side of the trapezoid, said second side being opposite to the first side, such that the direction of the threaded hole and a third side and a fourth side of the trapezoid, said fourth side being opposite thereto, in each case enclose an angle of more than 0.

6. The handle according to claim 5, wherein the direction of the threaded hole and the third side and the fourth side of the trapezoid, said fourth side being opposite thereto, in each case enclose an angle of less than 90 degrees.

7. The handle according to claim 5, wherein the direction of the threaded hole is substantially aligned at a perpendicular angle to the first side of the trapezoid.

8. The handle according to claim 5, wherein in the fastened state the slot nuts are secured by means of the screws screwed into the threaded holes so as to face the main body by means of the first side of the trapezoid shape of the slot nuts, such that longitudinal directions of the trapezoid shape of the slot nuts are inclined towards one another and the main profiled part is clamped between the slot nuts by means of the third and fourth sides of the trapezoid shape of the two slot nuts.

9. A handle for attachment to a main body by means of screws, comprising:

a main profiled part having two end portions, each end portion having a respective receiving portion at the respective end portion of the main profiled part, wherein the receiving portions extend so as to be inclined to one another; and two slot nuts, which have respective threaded holes for receiving the screws, wherein each of the slot nuts is made to be slidably inserted in the respective receiving portion, and wherein at least part of the outer profile cross-section of the slot nuts corresponds in shape to and mates with respective inner profile cross-sections of the receiving portions;

wherein the handle can be rigidly fixed to the main body when each of the slot nuts is slidably inserted in the respective receiving portion and is rigidly fixed to the main body by the respective screw, which passes through the main body, being screwed into the respective threaded hole of the respective slot nut, such that tensile stresses are generated in the direction of a surface of the main body and the main profiled part is clamped between the rigidly fixed slot nuts, wherein at least three sides of a longitudinal section of one of the receiving portions have a first trapezoid shape, wherein a first side of the first trapezoid shape corresponds to an opening of the main profiled part at the end and the at least three sides of the first trapezoid shape furthermore comprise a third side and a fourth side of the first trapezoid, said fourth side being opposite thereto, and the third and fourth sides of the first trapezoid shape correspond to wall portions of the receiving portion.

10. The handle according to claim 9, wherein the slot nut can be inserted in the corresponding receiving portion through the opening of the main profiled part at the end and is mounted to be slidable in the corresponding receiving portion in the direction of the parallel extending second and third sides of the first and/or second trapezoid form.

11. The handle according to claim 9, wherein the direction of the threaded hole is aligned substantially at a perpendicular angle to the first side of the first and/or second trapezoid; and the direction of the threaded hole and the third side and the fourth side of the first and/or second trapezoid, said fourth side being opposite thereto, in each case enclose an angle of more than 0 and/or less than 90 degrees.

12. A handle for attachment to a main body by means of screws, comprising:

a main profiled part having two end portions, each end portion having a respective receiving portion at the respective end portion of the main profiled part, wherein the receiving portions extend so as to be inclined to one another; and two slot nuts, which have respective threaded holes for receiving the screws, wherein each of the slot nuts is made to be slidably inserted in the respective receiving portion, and wherein at least part of the outer profile cross-section of the slot nuts corresponds in shape to and mates with respective inner profile cross-sections of the receiving portions;

wherein the handle can be rigidly fixed to the main body when each of the slot nuts is slidably inserted in the respective receiving portion and is rigidly fixed to the main body by the respective screw, which passes through the main body, being screwed into the respective threaded hole of the respective slot nut, such that tensile stresses are generated in the direction of a surface of the main body and the main profiled part is clamped between the rigidly fixed slot nuts, wherein at least three sides of a longitudinal section of one of the slot nuts have a second trapezoid shape, wherein a first side of the second trapezoid shape has the threaded hole and the threaded hole extends from the first side of the second trapezoid to a second side of the slot nut, said second side being opposite to the first side, and the at least three sides of the second trapezoid shape further comprise a third side and a fourth side of the second trapezoid, said fourth side being opposite thereto.

13. A handle for attachment to a main body by means of screws, comprising:

a main profiled part having two end portions, each end portion having a respective receiving portion at the respective end portion of the main profiled part, wherein the receiving portions extend so as to be inclined to one another; and two slot nuts, which have respective threaded holes for receiving the screws, wherein each of the slot nuts is made to be slidably inserted in the respective receiving portion, and wherein at least part of the outer profile cross-section of the slot nuts corresponds in shape to and mates with respective inner profile cross-sections of the receiving portions;

wherein the handle can be rigidly fixed to the main body when each of the slot nuts is slidably inserted in the respective receiving portion and is rigidly fixed to the main body by the respective screw, which passes through the main body, being screwed into the respective threaded hole of the respective slot nut, such that tensile stresses are generated in the direction of a surface of the main body and the main profiled part is clamped between the rigidly fixed slot nuts, wherein a first one of the slot nuts can be inserted in a first one of the receiving portions at the end, such that the first slot nut is slidable in the first receiving portion in a first direction of the receiving portion, and at the end in such a way that the second slot nut is slidable in the second receiving portion in a second direction of the receiving portion, wherein the first direction and the second direction are inclined towards one another.

14. The handle according to claim 13, wherein the first direction and the second direction enclose an angle between substantially 30 and 120 degrees.

* * * * *